United States Patent [19]

Miller

[11] 4,010,946

[45] Mar. 8, 1977

[54] LUNG EXERCISE DEVICE

[75] Inventor: James Granville Miller, Northwood, Ohio

[73] Assignee: Owens-Illinois, Inc., Toledo, Ohio

[22] Filed: Nov. 24, 1975

[21] Appl. No.: 634,111

[52] U.S. Cl. ..... 272/99; 137/142; 137/854; 124/2.08

[51] Int. Cl.[2] ..... A63B 23/00

[58] Field of Search ..... 272/99; 128/2.08; 137/151, 519, 525.1, 525.3

[56] References Cited

UNITED STATES PATENTS

| | | | |
|---|---|---|---|
| 570,833 | 11/1896 | Williams | 137/519 X |
| 681,841 | 9/1901 | Weston | 137/519 X |
| 1,002,252 | 9/1911 | Fitts et al. | 137/519 |
| 3,182,601 | 5/1965 | Johnson | 137/519 X |
| 3,416,563 | 12/1968 | Lee | 137/519 |
| 3,511,228 | 5/1970 | Lundgren et al. | 272/99 X |
| 3,936,048 | 2/1976 | Dunlap et al. | 272/99 |

OTHER PUBLICATIONS

Vernay Catalog – Custom Engineered Check Valves, pp. 1 to 6.

*Primary Examiner*—Jerome Schnall
*Attorney, Agent, or Firm*—Carl G. Staelin

[57] ABSTRACT

An improved "blow bottle" for forced expiration exercise wherein liquid is blown from one container to a higher container and then automatically returned to the first container when filled by a siphon whose priming operation is facilitated and rendered more reliable by an umbrella check valve.

7 Claims, 9 Drawing Figures

LUNG EXERCISE DEVICE

Figure 2:
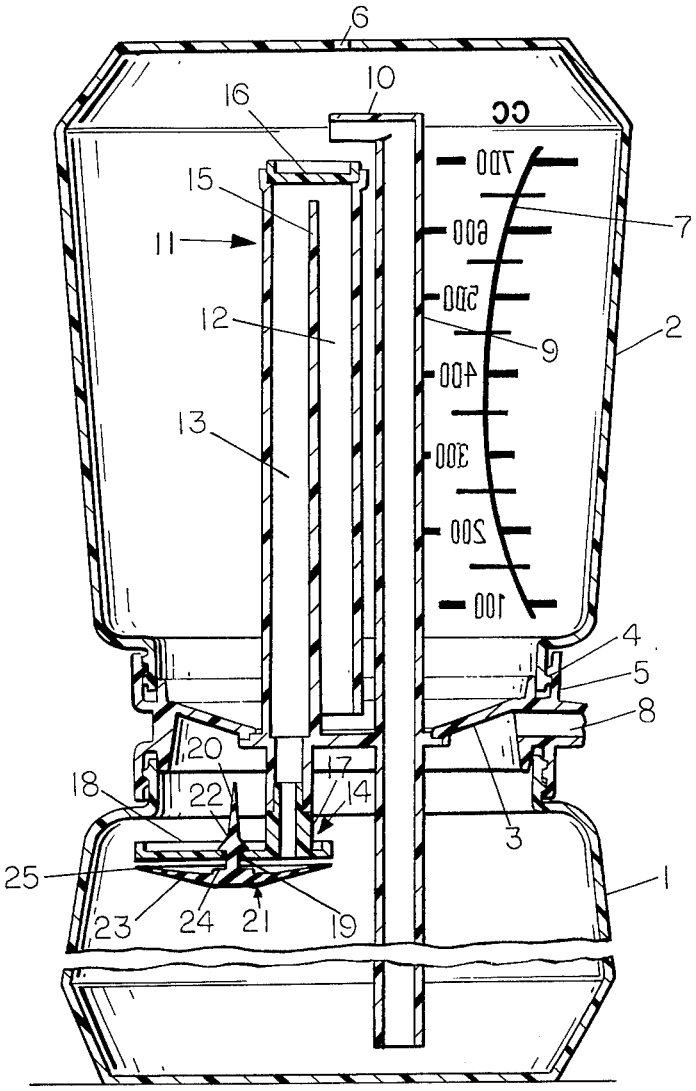

This invention relates to an improved device for respiratory exercise wherein liquid can be blown by a patient from one container to a higher container to exercise his lungs by repeated blowings, and when the liquid in the higher chamber reaches a predetermined level an improved siphon device automatically returns the liquid to the first container. More particularly, the invention facilitates priming of the siphon and renders it more consistent and reliable in operation.

This invention is an improvement on the lung exercise device disclosed in commonly assigned copending U.S. patent application of Dunlap et al, Ser. No. 539,292 filed Jan. 3, 1975, now U.S. Pat. No. 3,936,048 which discloses a lung exercise device in which the siphon device is provided with a check valve in the form of a duck bill or in the form of a flexible flapper of rubber or like material or a swing check valve. Such check valves, however, can on occasion malfunction by failing to prime the siphon when the liquid in the upper container has reached its predetermined level because of back pressure from the check valve or the check valve may remain slightly open for the admission of air during the blowing step because of sticking of the valve.

To overcome these problems, the present invention provides a siphon assembly with an umbrella valve of flexible preferably elastomeric material such as natural or synthetic rubber, which is designed to have practically no back or cracking pressure to impede the priming action of the siphon. It also can retain a reservoir of liquid which when the valve is closed during the blowing step provides a hydrostatic head of liquid within the tube directly above and connecting with the check valve. This head of liquid becomes available to assist by suction in priming the siphon when the liquid in the upper container has risen sufficiently to a predetermined top level. At this stage in the operation, the head of liquid in the lower container supplements the head of liquid in the upper container to assist in overcoming surface tension and frictional effects in the siphon to cause a relative on-rush of liquid over the high point in the siphon to aid in priming and return of liquid to the lower container.

Umbrella valves have been previously known as for example those produced by Vernay Laboratories, Inc. of Yellow Springs, Ohio and shown in their catalogue, as for example their catalogue published in 1972 entitled "Vernay Custom Engineered Check Valves" illustrating on page 2 several umbrellas with typical installations. However, these umbrellas are not shown assoicated with a siphon to assist in its priming or in connection with a sensitive respiratory exercise device. As shown in the catalogue, the umbrellas are in fixed closed positions at which point the flexible cup shaped member is in a preloaded condition and thus requires added pressure to open the valve. In contrast, as will be explained more fully, the umbrella of the present invention hangs downwardly, closes when external pressure is applied from below and opens automatically when pressure is removed with minimum or no back or cracking pressure required.

The present invention is especially advantageous in providing great sensitivity to the device because of the relatively low pressure from the small head of liquid such as one or two centimeters, available to overcome the surface tension, and friction effects of the liquid to initiate priming. This is an improvement over the duck bill check valve of Ser. No. 539,292 or other preloaded closing systems which have to overcome not only these forces but back pressures induced by the forces required to keep the valves in a normally closed condition.

Another advantage of the present invention is to provide a siphon assembly which can be manufactured inexpensively by injection molding, even though the cross-section of the flow of fluid at the high point of the siphon may not necessarily be circular and differ from that in the main body of the tubes, thus presenting differing surface tension or capillary forces to the flow of fluid at this point.

Another advantage is ease of assembly and cleaning of parts.

Figure 1:
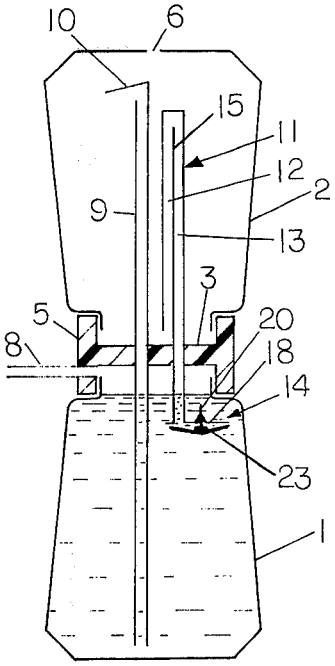
Figure 3:
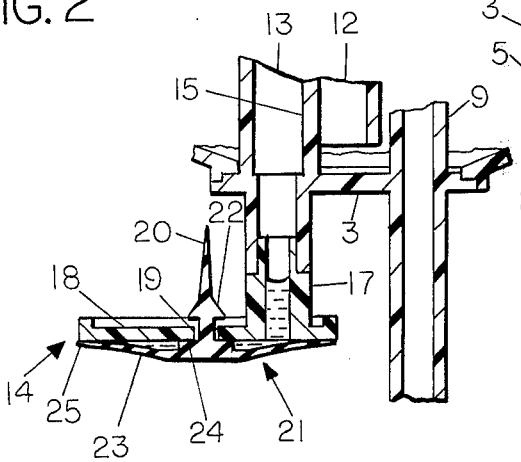
Figure 4:
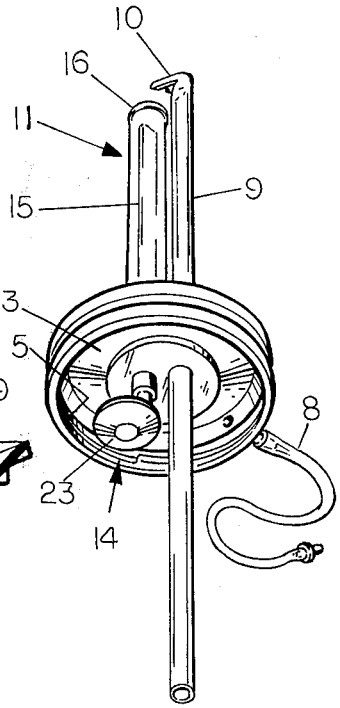
Figure 9:
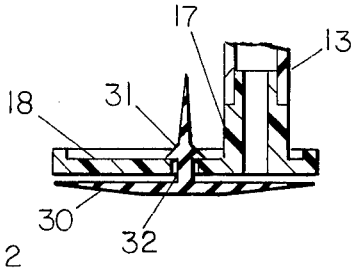

Other objects accomplished by the present invention will appear in the following description which is illustrated in the drawings herein:

FIG. 1 — is schematic cross-sectional view of the device for respiratory exercise incorporating the present invention, FIG. 2 — is cross-sectional, partially fragmented view of the device in FIG. 1 viewed from the opposite side, and showing the check valve in open position, FIG. 3 — is a cross-sectional fragmented view of the check valve in a closed position, FIG. 4 — is a perspective view of the siphon device, septum and the improved check valve, FIGS. 5 through 8 — are additional schematic representations illustrating steps in the sequence of operation of the invention, FIG. 9 — is a fragmented cross-section of a modified embodiment of the umbrella valve shown in open position.

As shown in FIGS. 1 and 2 the invention comprises a lower container 1 and an upper container 2, each of which are generally about a liter capacity and interconnected through a septum 3. As shown in FIGS. 2 and 4, each container is preferably removably fitted to the septum by mating screw threads 4 on the containers and on the inner sidewall 5 of the septum respectively. The upper container communicates with the atmosphere through an air hole 6 shown in FIGS. 1 and 2, and can be provided for convenience to the patient with liquid level markings 7. These can be read directly by the patient when the upper container is made of translucent material such as glass or preferably plastic.

The sidewall 5 of the septum 3 is provided with an external blow tube 8 through which the patient blows air into the lower container. This air applies pressure forcing the liquid to the upper container through the liquid transfer tube 9 which extends through the septum 3 from near the bottom of the lower container to near the top of the upper container, expelling air through the air hole 6.

The top of the transfer tube 9 may have a deflector 10 to prevent splashing out the air hole. Also connected to the septum 3 in the upper container is a siphon 11 made in the general form of an inverted U composed preferably of a rigid plastic material, comprising an intake tube 12 which is open at its lower end near the septum and an outlet tube 13 which passes through the septum 3 into the lower container and holds the improved check valve assembly 14. In the form shown the siphon is made of a simple press molding of plastic material wherein the intake and outlet tubes 12 and 13 together form a cylinder divided into two compartments by a dividing wall 15. The top of the dividing wall acts as a weir over which the liquid may flow when the level of the liquid in the upper container rises sufficiently above the dividing wall 15. The top of the siphon 11 may be provided with a cap 16 to close and seal the tubes.

The check valve assembly 14 has a tube section 17 connected to the lower end of the outlet tube 13 and is preferably integral with a valve seat or base plate 18 which faces downwardly and preferably is in a horizontal position. This base plate has an opening 19 preferably near the center of the plate through which the stem 20 of an elastic umbrella valve 21 can be introduced and be held in position on the plate by means of the flange 22. The lower end of the stem 20 is preferably integral with a concave or dish-shaped member 23. An abutment 24 is provided in the lower end of the stem 20 which serves to seal the opening 19 against the passage of air when the valve is closed. The flange 22 is preferably spaced sufficiently from the abutment 24 to permit a reciprocating movement of the umbrella valve from its open and closed positions respectively. In the open position shown in FIG. 2 the periphery 25 of the dish-shaped member is preferably spaced slightly away from the base plate 18 and thus facilitates the discharge of fluid through the tube 17 which forms an aperture through the valve seat or base plate 18 into the bottom container. Surface tension between the base plate 18 and the dish-shaped member helps retain some of the liquid in the dish-shaped member. In the closed position shown in FIG. 3 the periphery 25 of the dish-shaped member abuts against the plate and seals the further passage of air into the dish-shaped member and tube section 17. A reservoir of liquid is retained in the dish-shaped member when the umbrella valve is in the open position. When the valve is closed the major portion or substantially all of this liquid is forced upwardly through the tube 17 into the lower end of the outlet tube 13. At this stage this liquid provides a head which becomes available to assist in the priming of the siphon as shown in FIG. 3.

The sequence of operation can best be seen from FIGS. 1, 4, 5, 6, 7 and 8. In FIG. 1 the lower container 1 is filled with a convenient liquid such as water which can be colored for easier viewing. At this stage the check valve assembly 14 is in an open position as shown in FIG. 2.

Figure 5:
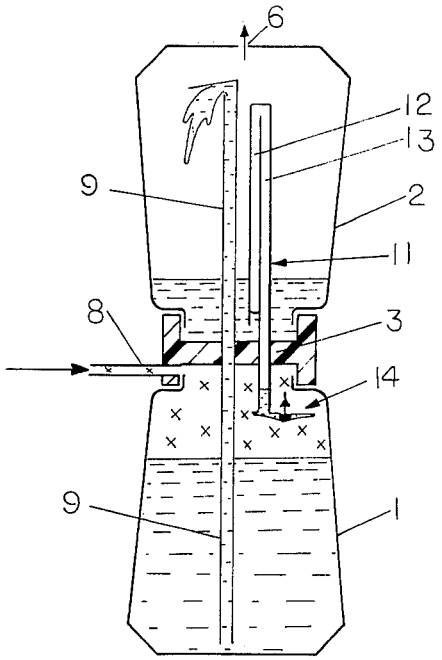
Figure 6:
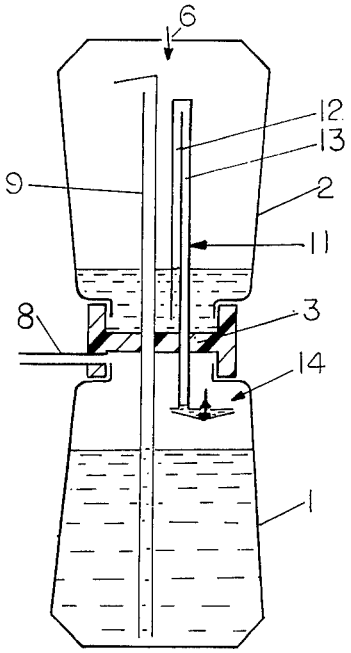

When the patient blows into the blow tube 8, pressure increases in the lower container which then closes the check valve 14 as shown in FIGS. 3 and 5. The liquid rises through the liquid transfer tube 9 and spills into the upper container 2. The reservoir of liquid lying within the concave section of the dish-shaped member 23 is forced into the tube section 17 which is part of the siphon 11. If the patient stops blowing to rest his lungs, the pressure in the lower container 1 is reduced to zero and the check valve opens by its own weight and that of the liquid in the tube section 17 as shown in FIGS. 2 and 6. This liquid is caught in the dish-shaped portion of the check valve 14. Liquid will now pass into the lower end of the intake tube 12 to the level of liquid in the upper container as shown in FIG. 6.

Figure 7:
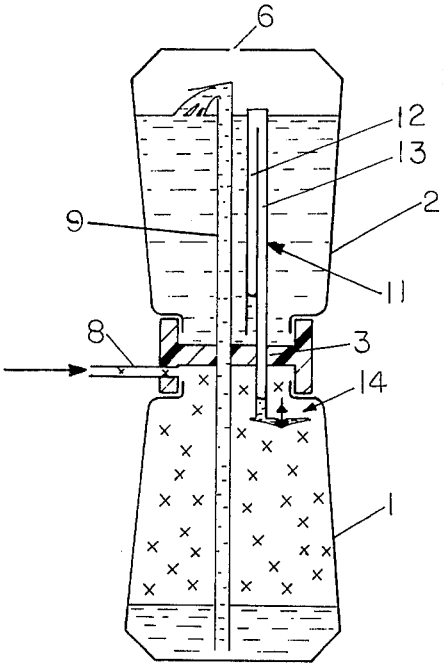

When the patient resumes blowing the check valve will again close and form a head of liquid in tube section 17 as shown in FIG. 3 and commensurately depresses the liquid level in tube 12 as shown in FIG. 7. The liquid from the lower container will resume flow through the transfer tube 9.

By continuing blowing the liquid level in the upper container 2 will continue to rise thus providing a head of liquid above the top of the dividing wall 15 in the siphon. At this stage the head of liquid in the upper container combines with the suction induced by the head of liquid above the check valve in the tube section 17 to exert an augmented pressure upon the liquid in the siphon. Thus, when the patient stops blowing at this stage, the priming action, is accentuated overcoming surface tension of the liquid at the top of the siphon and liquid frictional effects which may very depending on additives affecting viscosity and surface tension of the liquid. The liquid in the upper container automatically passes through the siphons to the lower container 1 to complete the cycle as shown in FIG. 8.

Figure 8:
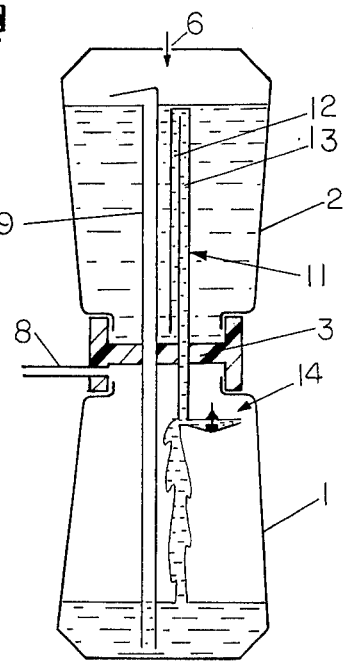

It can be seen that the priming effect is facilitated by the fact that the umbrella valve assembly 14 will drop by gravity to its lower position as shown in FIGS. 2 and 8 with substantially no impediment or back pressure that otherwise may be induced through a duck bill or flap valve or fixed closed valve in preloaded condition.

Various alternative details of construction and assembly of the elements described can be employed within the scope of the present invention. The dish-shaped member 23 can be enlarged and deepened in shape to hold a larger quantity of liquid when in the open position. When the valve is closed this liquid provides a greater head and serves to provide greater suction effect when the siphon is ready for priming. It is thus possible to initiate priming when the level of liquid in the upper container is still below the top of the siphon.

Another alternative as shown in FIG. 9 is to provide an outwardly flared rim member 30 of the umbrella valve so as to lie substantially or actually in a flat plane in proximity to the base plate, but retaining sufficient spacing between the flange 31 and the abutment 32 to provide a reciprocating movement to the umbrella valve between open and closed positions. This would give a low or zero cracking pressure to the valve with sufficient head of liquid in the upper container and facilitate priming of the siphon through the weight of the umbrella valve. In the open position, a small amount of liquid is retained by surface tension between the base 18 and the rim member 30 of the valve.

For convenience in disclosure all patent documents and references mentioned herein are incorporated by reference.

Another advantage of the umbrella valve as shown is that it can easily be removed by pulling the flange 22 through the hole 19 shown in FIG. 3, then cleaned and reinserted by pulling the stem 20 through the opening 19.

I claim:

1. In a device for forced expiration exercise wherein liquid is blown from a lower container to an upper container communicating with each other through an interconnecting liquid transfer tube, having means for accommodating the blowing of air pressure into the lower container and forcing liquid through the transfer tube to the upper container, the combination of a siphon in the upper container having a discharge tube communicating with the lower container, a downwardly disposed valve seat connected to and surrounding the lower end of the discharge tube and having an aperture therethrough communicating with the discharge tube, and a flexible coacting dish-shaped valve member located beneath the valve seat in juxtaposed relationship therewith and supported from said valve slot for limited movement toward and away from said valve seat, the outer periphery of said dish-shaped valve member forming a continuous seal surrounding said aperture to limit the upward movement of fluid through said aperture into the discharge tube when blowing pressure is introduced into said lower container and adapted to unseat by the aid of gravity with substantially no back cracking pressure and permit the downward flow of liquid through said aperture when the blowing pressure is relieved and sufficient liquid has been forced into the upper container to prime said siphon, and said dish-shaped valve member adapted to retain liquid when said valve is unseated to be available to seal against the passage of air through said aperture when blowing pressure is commenced and then to form a head of liquid in the lower end of said discharge tube to assist in the priming of said siphon.

2. The device of claim 1 wherein said dish-shaped valve member is integral with a reciprocating stem to form an umbrella valve and the stem is slidably supported by the valve seat.

3. The device of claim 2 wherein said valve seat is provided with an opening spaced away from said aperture to receive said stem which has a flange projecting over said opening to provide support for said dish-shaped valve member.

4. The device of claim 3 wherein said flange is spaced sufficiently from said dish-shaped valve member to permit reciprocating movement to the stem, and at its lower limit of movement, the periphery of said dish-shaped member is spaced from said valve seat to facilitate the discharge of liquid.

5. The device of claim 1 wherein said dish-shaped valve member is positioned at its lower limit of movement to retain by surface tension a small amount of liquid between the periphery of the dish-shaped valve member and the valve seat and to hold liquid in the dish-shaped valve member when the external pressure is relieved, and said dish-shaped member is adapted to force said liquid upwardly into the siphon discharge tube when external pressure is applied to form a hydrostatic head of liquid therein to facilitate the priming of the siphon when the level of liquid in the upper container is sufficient to start the flow of liquid in the siphon into the discharge tube.

6. A device for forced expiration exercise wherein liquid is blown from a lower container to an upper container, said containers communicating with each other through an interconnecting liquid transfer tube, with means for blowing pressure into the lower container and forcing liquid through the transfer tube to the upper container, a siphon in the upper container with its discharge tube communicating with the lower container, and a check valve positioned on said discharge tube, the improvement wherein said check valve comprises:

means surrounding said discharge tube and defining a valve seat having a bottom surface exposed downwardly, said valve seat having an aperture communicating with said siphon discharge tube, said valve seat further including an opening laterally offset from said discharge tube and adapted to receive a valve stem, and a flexible coacting valve having flared rim positioned beneath and surrounding said aperture and a stem penetrating upwardly through said opening in the valve seat, said stem having an enlarged portion greater than said opening and located above the bottom surface of the valve seat to limit downward movement, and the said rim having its peripheral portion positioned in proximity to the valve seat and adapted to limit upward movement of liquid through the discharge tube when external pressure is applied and permitting downward movement of liquid from said discharge tube when external pressure is relieved the stem and flared rim being mounted to permit freedom of reciprocal upward and downward movement and said valve being spaced at least partially away from said valve seat when external pressure is relieved and enable a thin layer of liquid to be retained by surface tension between the flared rim and the valve seat when external pressure is relieved and is capable of forcing a portion of said liquid at least partially into the discharge tube when external pressure is applied to form a head of liquid to assist the priming of the siphon when sufficient liquid has been forced into the upper container.

7. The device of claim 6 wherein the valve is umbrella-shaped with a concave surface facing said valve seat, and in which the enlarged portion of the stem and the flared rim are sufficiently spaced from each other to permit limited reciprocating movement thereof, the said flared rim adapted to permit the passage of liquid by gravity when external pressure is removed from the umbrella-shaped valve in the lower container.

* * * * *